US011659929B2

(12) United States Patent
Paradis et al.

(10) Patent No.: US 11,659,929 B2
(45) Date of Patent: May 30, 2023

(54) DOUBLE ACTION NOSE MOUNT QUATTRO STANCHION

(71) Applicant: Hussey Seating Company, North Berwick, ME (US)

(72) Inventors: James Paradis, West Newfield, ME (US); John Fisher, Yarmouth, ME (US); Paul-Jacob Michael Richmond, Biddeford, ME (US)

(73) Assignee: Hussey Seating Company, North Berwick, ME (US)

( * ) Notice: Subject to any disclaimer, the term of this patent is extended or adjusted under 35 U.S.C. 154(b) by 45 days.

(21) Appl. No.: 17/004,519

(22) Filed: Aug. 27, 2020

(65) Prior Publication Data

US 2021/0068546 A1 Mar. 11, 2021

Related U.S. Application Data

(60) Provisional application No. 62/896,667, filed on Sep. 6, 2019.

(51) Int. Cl.

| | |
|---|---|
| ***E04H 3/12*** | (2006.01) |
| ***A47C 1/126*** | (2006.01) |
| ***A47C 1/121*** | (2006.01) |
| ***A63J 25/00*** | (2009.01) |

(52) U.S. Cl.

CPC ..... *A47C 1/121* (2013.01); *A63J 25/00* (2013.01); *E04H 3/123* (2013.01)

(58) Field of Classification Search

CPC .. E04H 3/12; E04H 3/10; E04H 3/123; E04H 3/126; A47C 1/126; A47C 1/121; A47C 1/12

USPC ..... 52/6–10; 297/236

See application file for complete search history.

(56) References Cited

U.S. PATENT DOCUMENTS

| | | | | | |
|---|---|---|---|---|---|
| 2,987,111 | A * | 6/1961 | Walworth | E04H 3/123 | 52/9 |
| 3,025,106 | A * | 3/1962 | Evans | A47C 1/126 | 297/378.12 |
| 4,000,586 | A * | 1/1977 | Vance | E04H 3/123 | 52/9 |
| 4,063,392 | A * | 12/1977 | Van Ryn | E04H 3/123 | 52/9 |
| 4,155,202 | A * | 5/1979 | Hartman | A47C 1/126 | 52/9 |

(Continued)

*Primary Examiner* — Kyle J. Walraed-Sullivan

(74) *Attorney, Agent, or Firm* — Preti Flaherty Beliveau & Pachios LLP

(57) ABSTRACT

A double action seating unit to be mounted to a nose of a platform is described. The double action seating unit includes a seat assembly, a back assembly and at least two stanchion. Each stanchion has a front bracket, a rear bracket, a stanchion tube and two pivot straps. The front bracket attaches the seat portion to the stanchion, the rear bracket attaches the stanchion to the nose of the platform and the stanchion tube attaches the back assembly to the stanchion. Each pivot strap connects an associated stanchion tube, the rear bracket and the front bracket. The double action seating unit can move between a use configuration and a storage configuration. The two pivot straps cause the seat assembly and the back assembly to simultaneously rotate when the double action seating unit moves between the use configuration and the storage configuration.

16 Claims, 11 Drawing Sheets

(56) References Cited

U.S. PATENT DOCUMENTS 4,189,876 A * 2/1980 Crossman ..... A47C 1/126 52/9
4,211,450 A * 7/1980 Sutter ..... A47C 1/12 297/331
4,557,080 A * 12/1985 Walworth ..... E04H 3/123 52/9
5,328,238 A * 7/1994 Yamazaki ..... A47C 1/126 52/9
5,459,964 A * 10/1995 Doublet ..... A47C 1/126 52/7
5,685,608 A * 11/1997 Yamazaki ..... A47C 1/126 52/9
5,819,475 A * 10/1998 Momose ..... E04H 3/123 297/331
6,000,174 A * 12/1999 Yamazaki ..... A47C 1/126 52/9
6,055,780 A * 5/2000 Yamazaki ..... E04H 3/123 52/9
6,244,657 B1 * 6/2001 Momose ..... E04H 3/123 297/331
6,625,932 B1 * 9/2003 Littlefield ..... E04H 3/123 52/10
2001/0054835 A1 * 12/2001 Feng ..... A47C 1/126 297/15
2003/0200703 A1 * 10/2003 Suprina ..... E04H 3/126 52/9
2007/0007809 A1 * 1/2007 Han ..... A47C 1/12 297/378.1
2008/0190038 A1 * 8/2008 Jacobs ..... E04H 3/123 52/9
2011/0016798 A1 * 1/2011 Jacobs ..... A47C 1/126 52/9
2013/0019539 A1 * 1/2013 Gardner ..... E04H 3/14 52/705
2013/0019540 A1 * 1/2013 Magnus ..... E04H 3/126 52/8

* cited by examiner

Elevation of Extended Seating Unit

Elevation of Closed Seating Unit

Elevation of Extended Seating Unit

Elevation of Closed Seating Unit

DOUBLE ACTION NOSE MOUNT QUATTRO STANCHION

BACKGROUND OF THE INVENTION

Various embodiments relate generally to seating systems and devices and, more specifically, relate to folding and telescopic bleachers.

This section is intended to provide a background or context. The description may include concepts that may be pursued, but have not necessarily been previously conceived or pursued. Unless indicated otherwise, what is described in this section is not deemed prior art to the description and claims and is not admitted to be prior art by inclusion in this section.

Folding and telescopic seating structures 102 are bleachers that can be retracted or closed into a compact vertical stack of tiered seating to save floor space. FIGS. 1A and 1B, collectively referred to as FIG. 1, show a prior art telescopic seating structure 102 with a standard nose mounted chair 103 mounted to the last row of a telescopic seating structure 102 in both extended (FIG. 1A) and closed (FIG. 1B) configurations. As shown, each tier of seating, when open or closed, needs to slide past the adjacent tiers and in certain cases, store completely underneath the balcony 101 or other seated platforms.

Certain venues can have a large, comfortable chair 103, which given its magnitude cannot fit within the structure's envelope and therefore must be attached to the front beam (hereafter referred to as the nose 105) of the tiered seating structure 102. See FIG. 1 as an example of a standard seating section. These larger parts prevent the telescopic structure 102 from storing under a balcony 101 with small clearances to the top of the structure 102. This requires that the entire unit 102 sit in front of the balcony 101 causing the closed dimension to be large. FIG. 11 shows a side by side comparison showing the clearance gained by using a standard prior art chair 103 (Left) and a double action chair 104 in accordance with the present invention (Right).

A common application in spectator seating systems is a recessed telescopic seating structure 102 that, when in use, will transition to a secondary level 101 within a venue. For this application it is imperative that the seating platform structure 102 can fit fully below the balcony 101 with operational clearance. This clearance then dictates what the overall height of the platform 102 can be and therefore will limit the number of rows that can be used on that platform 102. If a given platform 102 also has a nose mounted chairs 103, then this component will commonly become the highest point on the platform 102. With the chair 103 being the highest point on the unit 102, the limitations of the platform 102 will revolve around them.

One typical solution would be to have the top row of the telescopic seating structure 102 sit low enough that the highest point on the chairs 103 do not contact the balcony 101. In some cases, this will cause the dimension between the last row of the platform 102 and the tread on the balcony 101 to be large enough that it will require a three-tread transition. This kind of transition requires a larger row space on the top row of the platform 102 to account for the extra step. This approach could have a negative impact on the sightlines for patrons in that row due to the height limitation. Another, common application for these telescopic platforms 102 is to be adjacent to concrete risers. When used in these applications, the telescopic platforms 102 must have the same cross sectional geometry as the concrete to ensure there is no tripping hazards going from the platform 102 to the concrete and that the row of chairs is as consistent as possible. Therefore, increasing the dimension between the last row on the platform to the balcony 101 may not be possible when the platforms are used in this kind of application.

A second solution that some venues consider is to have the unit 102 hold close to the balcony 101 in the vertical direction. Then they increase the closed envelope of the platform 102 to prevent the nose mounted chairs 103 from hitting the balcony 101. This solution will decrease the amount of useable space left on the floor when the platform 102 is stored and therefore is not a desirable or a practical solution.

A third solution is to have a larger row space on the last tier of the platform 102 to allow for the use of portable chairs. This solution will provide a tighter fit to the balcony and may allow for another row to be added to the platform. However, it will require installation and removal of all the portable chairs for every event. For many venues, the aesthetics of having a different chair at this location is not an option.

Some venues may have the capability to work around these limitations, however, not all can. If a venue cannot utilize any of these solutions, they would have been required to compromise some aspect of their desired seating layouts.

What is needed are folding and telescopic seating structures which allow the entire telescopic platform to slide underneath a balcony or other tight spaces when installed on the top tier of seating.

BRIEF SUMMARY OF THE INVENTION

The below summary is merely representative and non-limiting.

The above problems are overcome, and other advantages may be realized, by the use of the embodiments.

In a first aspect, an embodiment provides a double action seating unit to be mounted to a nose of a platform. The double action seating unit includes a seat assembly, a back assembly and at least two stanchions. Each stanchion has a front bracket, a rear bracket, a stanchion tube and two pivot straps. The front bracket attaches the seat assembly to the stanchion, the rear bracket attaches the stanchion to the nose of the platform and the stanchion tube attaches the back assembly to the stanchion. Each pivot strap connects an associated stanchion tube, the rear bracket and the front bracket. The double action seating unit can move between a use configuration and a storage configuration. The two pivot straps cause the seat assembly and the back assembly to simultaneously rotate when the double action seating unit moves between the use configuration and the storage configuration.

BRIEF DESCRIPTION OF THE SEVERAL VIEWS OF THE DRAWINGS

Aspects of the described embodiments are more evident in the following description, when read in conjunction with the attached Figures.

DETAILED DESCRIPTION OF THE INVENTION

Figure 1A:
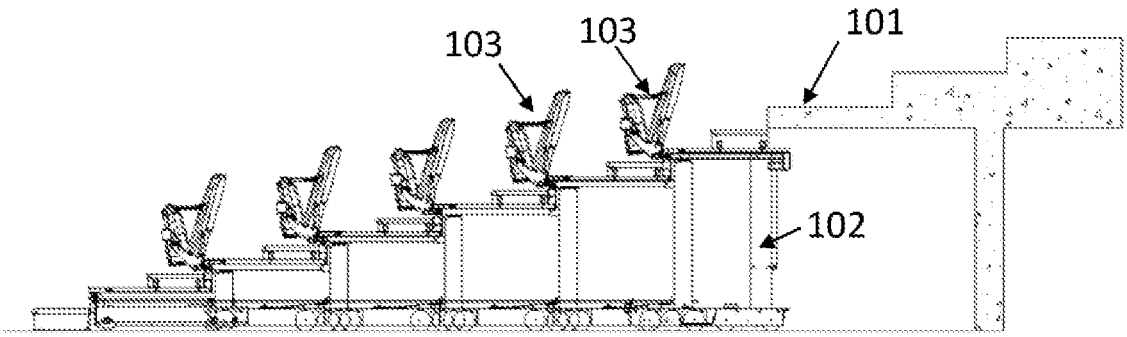
Figure 1A (PRIOR ART)
FIGS. 1A and 1B, collectively referred to as FIG. 1, show a telescopic seating structure with a standard nose mounted chair in the last row in both extended (FIG. 1A) and closed (FIG. 1B) configurations as known in the prior art.
Figure 1B:
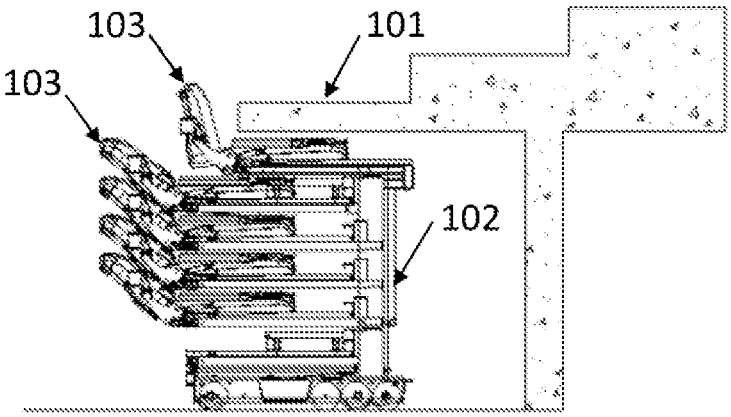
Figure 1B (PRIOR ART)

This patent application claims priority from US Provisional Patent Application No. 62/896,667, filed Sep. 6, 2019, the disclosure of which is incorporated by reference herein in its entirety.

Various embodiments of the present invention provide a "double action nose mounted stanchion" which serves to allow the seat 107 and mounting brackets 112 to fold forward and downwardly simultaneously with the standard operation of the chair back 106 being moved backwardly and downward, as will be explained below. This allows the entire telescopic platform 102 to slide underneath a balcony 101 or other tight spaces when installed on the top tier of seating. This ensures that the closed dimension of the unit is as small as possible. The design could be used on other tiers, however, the embodiments are discussed with respect to the top tier scenario.

These embodiments can be used in all folding and telescopic seating structures 102 that recess under a balcony 101 or fit within a tight space that utilize a nose mounted chair 103 on the topmost row of the seating structure. These systems are typically installed in school gymnasiums, theaters, arenas or stadiums, but not limited to these venues. An example includes Hussey Seating Company's MXP product line. There are numerous other manufacturers of telescopic seating structures.

Figure 2A:
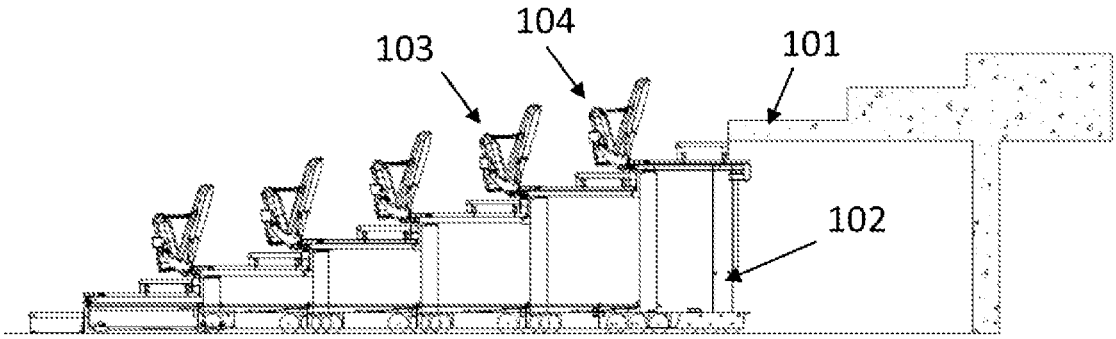
FIGS. 2A and 2B, collectively referred to as FIG. 2, show a telescopic seating structure with a double action chair installed on the top row in both extended (FIG. 2A) and closed (FIG. 2B) configurations according to the present invention.
Figure 2B:
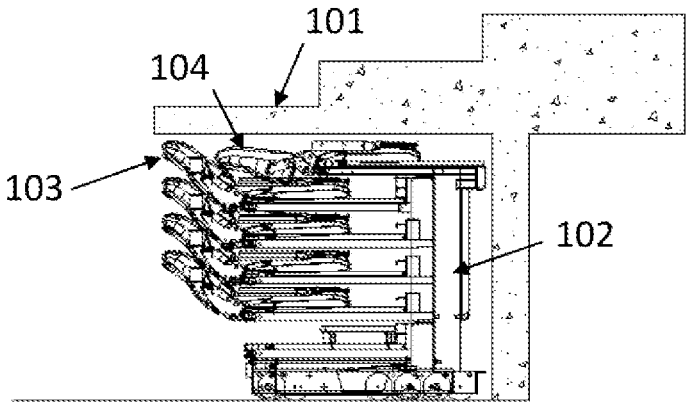

FIGS. 2A and 2B, collectively referred to as FIG. 2, show a telescopic seating structure 102 with a double action chair 104 in accordance with the present invention installed on the top row in both extended (FIG. 2A) and closed (FIG. 2B) configurations.

Figure 3:
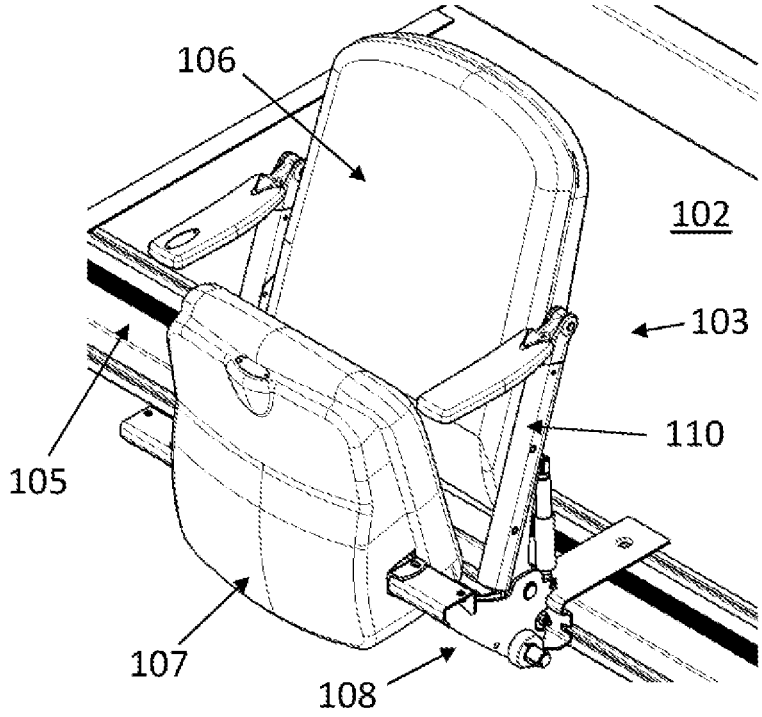
Figure 3 (PRIOR ART)
FIG. 3 is an isometric view of a standard nose mounted chair as known in the prior art.
Figure 4:
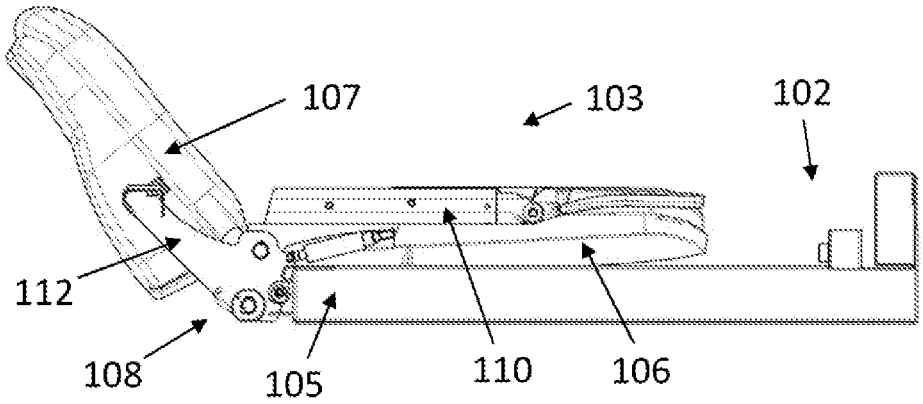
Figure 4 (PRIOR ART)
FIG. 4 is a side view of a standard nose mounted chair in the stored position as known in the prior art.
Figure 5A:
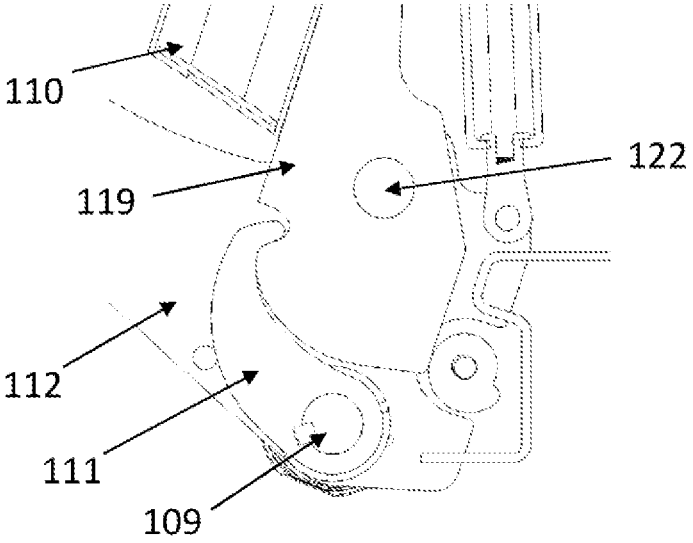
Figure 5A (PRIOR ART)
FIGS. 5A and 5B, collectively referred to as FIG. 5, illustrate cut views showing how a standard nose mounted stanchion of the prior art moves between locked (FIG. 5A) and unlocked (FIG. 5B) configurations.
Figure 5B:
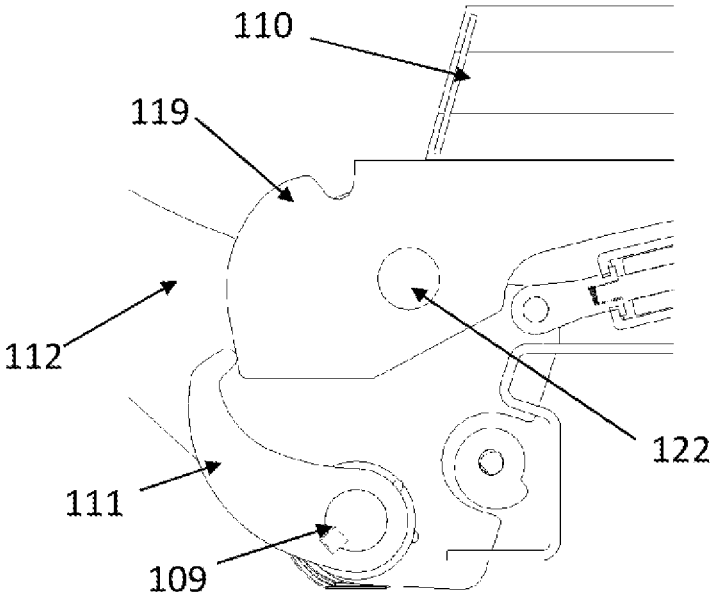
Figure 5B (PRIOR ART)
Figure 6A:
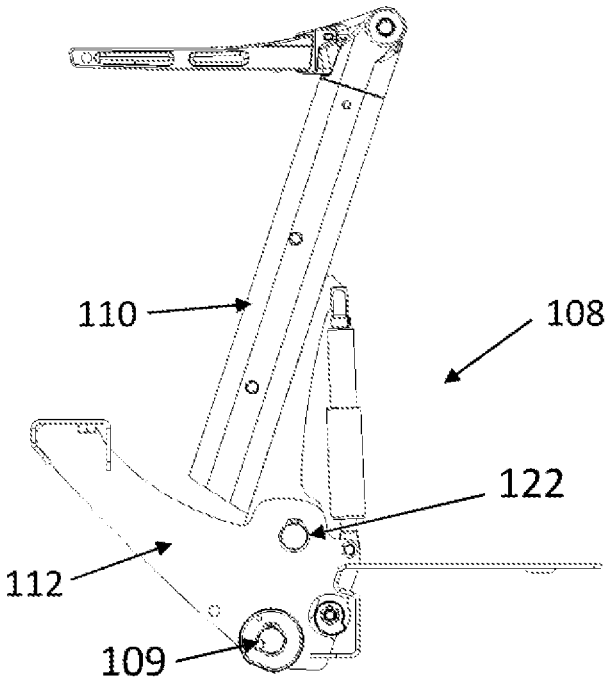
Figure 6A (PRIOR ART)
FIGS. 6A and 6B, collectively referred to as FIG. 6, illustrate a standard nose mount stanchion of the prior art positioned for use (FIG. 6A) and storage (FIG. 6B).
Figure 6B:
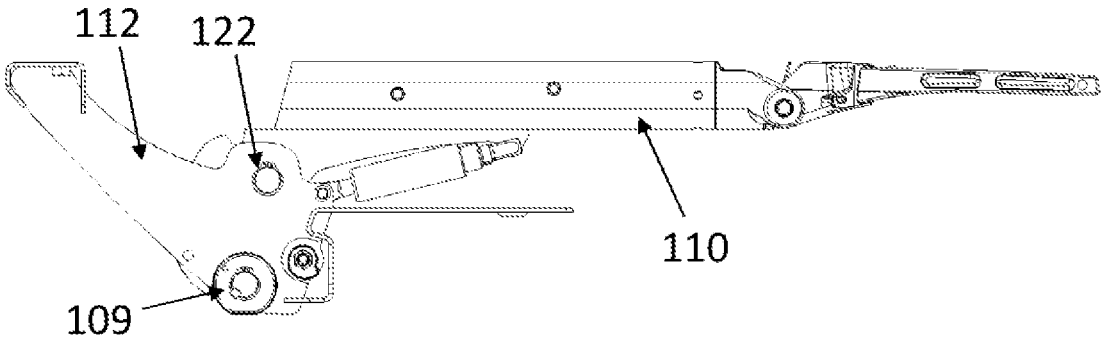
Figure 6B (PRIOR ART)

FIG. 3 is an isometric view of a typical prior art nose mounted chair 103. These chairs are constructed of three main parts: the back assembly (or back portion) 106, the seat assembly (or seat portion) 107 and the stanchions 108 (commonly referred to as standards). For a nose mounted chair 103, the stanchions 108 are the components that will attach the chair 103 to the platform 102 and dictate the seat height and back pitch of the chair. A stanchion 108, FIG. 4, is comprised of two main components: the bracket 112 and the stanchion tube 110. The bracket 112 is used to attach the stanchion 108 to the nose 105 of the platform 102 and to attach the seat 107 to the stanchion 108. The stanchion tube 110 attaches to the bracket 112 with a shaft and provides an attachment location for the back assembly 106 and the armrest. The nose mount stanchion 108 allows for a latch 111 FIG. 5A to rotate about the locking shaft 109 and release the back assembly 106 and stanchion tube 110 to rotate backwards so as to lay flat on the deck of the platform 102. The standard operation of a nose mount stanchion 108 can be seen in FIG. 5 and FIG. 6. FIGS. 5A and 5B, collectively referred to as FIG. 5, illustrate cut views showing how a standard prior art nose mounted stanchion 108 operates in both a locked (FIG. 5A) and unlocked (FIG. 5B) configuration. FIGS. 6A and 6B, collectively referred to as FIG. 6, illustrate a standard prior art nose mount stanchion 108 positioned for use (FIG. 6A) and storage (FIG. 6B).

With a standard prior art nose mounted stanchion 108, only the stanchion tube 110 will rotate. This means that the seat 107 will stay fixed and this will cause it to be the highest component of the seating assembly on the platform 102 when installed on the last tier of the unit as shown in FIG. 4 which is a side view of a standard nose mounted chair 103 in the stored position.

With the double action nose mount stanchion 113 according to the present invention, the operation of the stanchion, the back pitch, seat height, and installation method are all held constant. However, with this design the seat assembly 107 rotates forward and downward while the back assembly 106 is being rotated backward and downward to the stored position. To achieve this, the nose mount stanchion 108 is separated into four components: the front bracket 114, FIG. 7A, the rear bracket 115, pivot straps 116 and the stanchion tube (which may also be referred to as a backrest tube or armrest tube) 110.

Figure 7A:
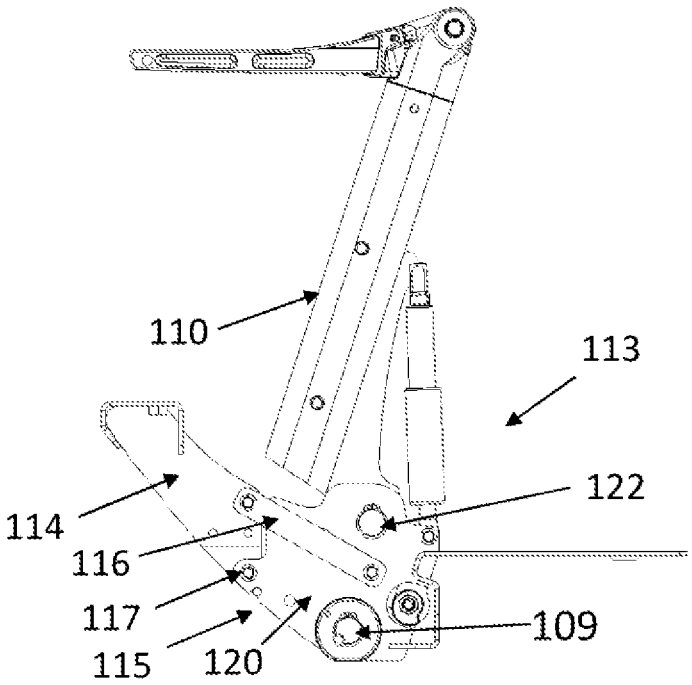
FIGS. 7A and 7B, collectively referred to as FIG. 7, illustrate an embodiment of the double action stanchion according to the present invention positioned for use (FIG. 7A) and storage (FIG. 7B).
Figure 7B:
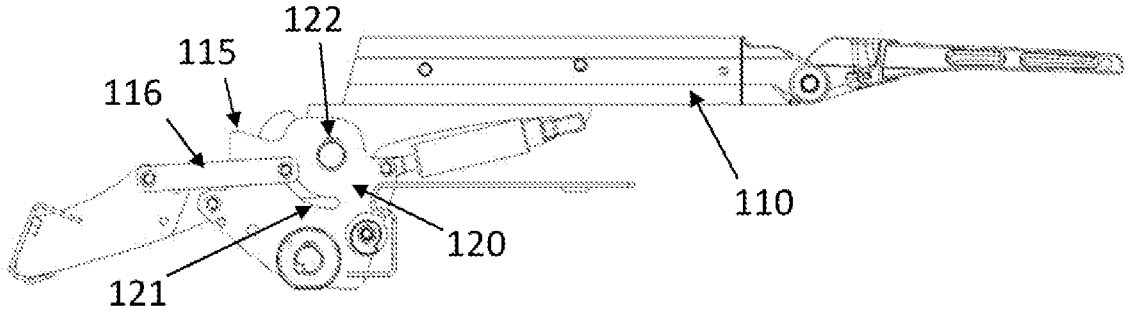

FIGS. 7A and 7B, collectively referred to as FIG. 7, illustrate an embodiment of a "double action" stanchion 113 according to the present invention positioned for use (FIG. 7A) and storage (FIG. 7B). The front bracket 114 is where the seat bottom attaches to when the stanchion 113 is assembled. The stanchion 110 has a thick steel center plate 119 FIG. 8 that fits between the side plates 120 of the rear bracket 115, which is what the front bracket 114 pivots on when operating. The rear bracket 115 is used to attach the stanchion 113 to the nose 105 of the platform 102. These side plates 120 also have two very precisely located curved slots 121 that arc around the pivot location 122 for the stanchion tube 110. One change to stanchion tube 110 from the standard one is a precisely located hole 123 in the stanchion tube center plate 119 to align with the slots 121 found in the side plates 120 of the rear bracket 115. The pivot straps 116 connect the stanchion tube 110 (and thus the seat back), with the front bracket 114 (and thus the seat bottom) together through the rear bracket 115, such that movement of the stanchion tube 110 and seat back causes simultaneous movement of the front bracket 114 and seat bottom.

Figure 8:
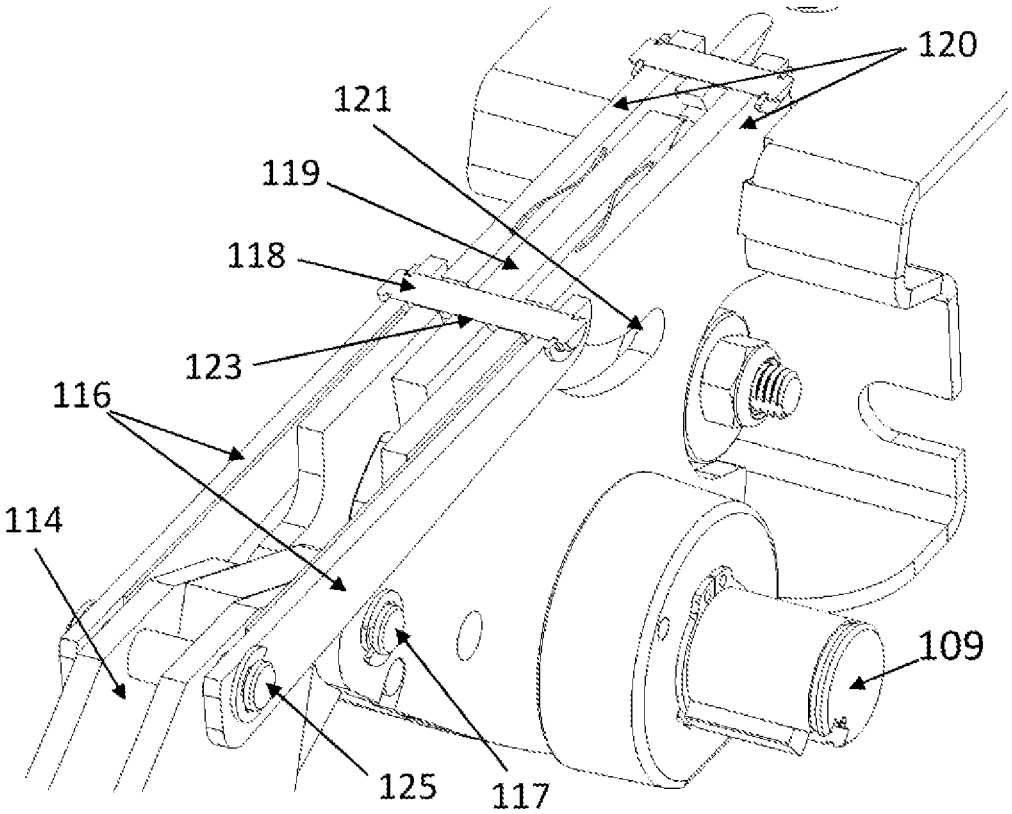
FIG. 8 shows a detailed cut view showing internal components of a double action stanchion according to the present invention.

With these three components (front bracket 114, rear bracket 115 and stanchion tube 110) of the double action stanchion 113 linked together by the fourth component (a set of two pivot straps 116), the double action stanchion 113 causes both the stanchion tube 110 and front bracket 114 to rotate together simultaneously as seen in FIG. 8 which shows a detailed cut view showing internal components of a double action stanchion 113. This is achieved by having a pin 118 that goes through a hole in the pivot straps 116, the curved slots 121 on both side plates 120 of the rear bracket 115, and a hole 123 in the center plate 119. When the stanchion tube 110 is unlocked and the seat back assembly 106 is being rotated back and downwardly to the stored position, the pin 118 and the attached straps 116 travel arcuately in the slots 121 and pushes the pivot straps 116 coupled to the front bracket 114 by pin 125 forward. This causes the front bracket 114 and seat bottom assembly 107 to rotate around the pivot pin 117 that attaches the front bracket 114 to the rear bracket 115.

Figure 9:
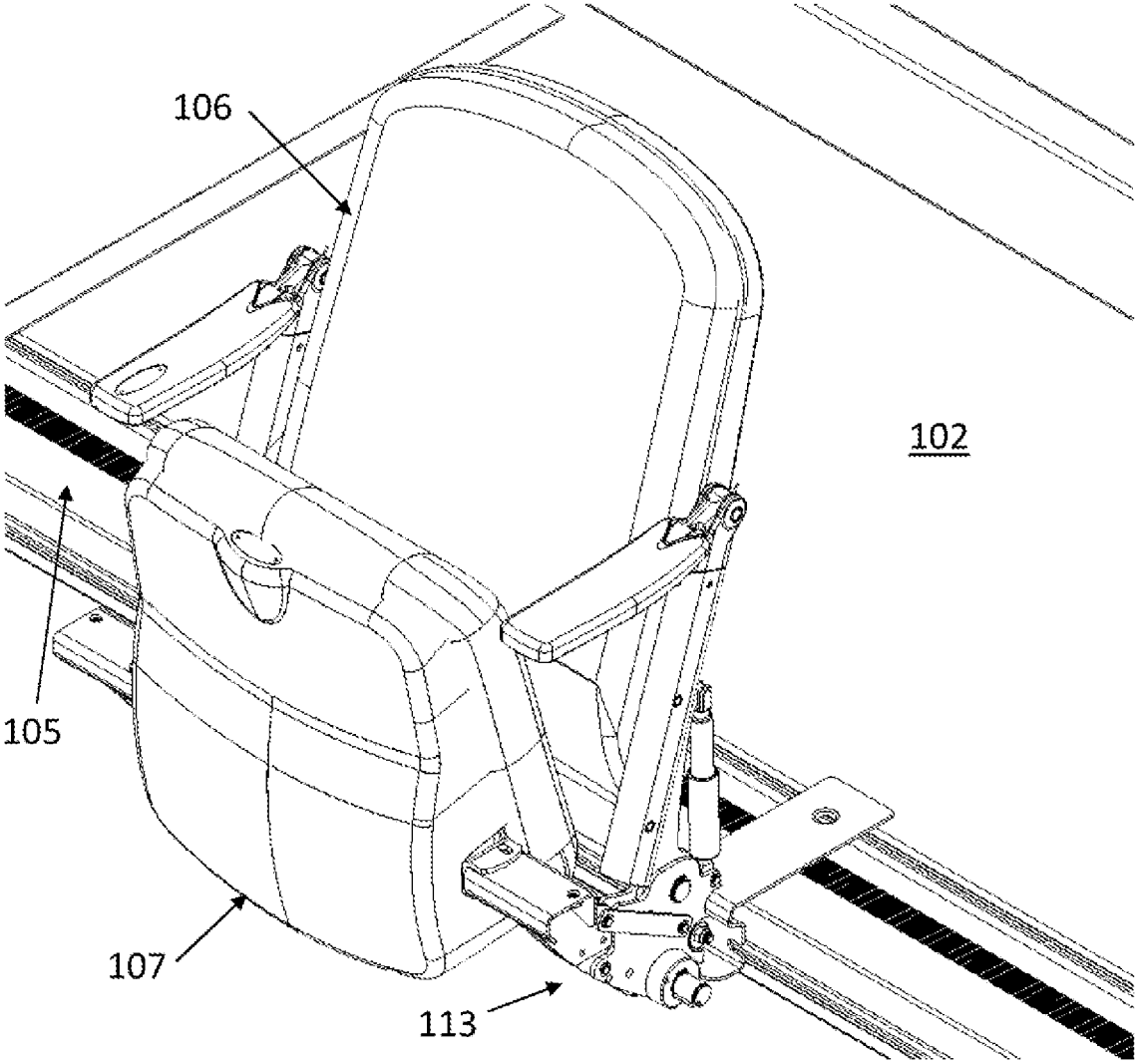
FIG. 9 is an isometric plan view of a double action nose mounted chair according to the present invention.
Figure 10:
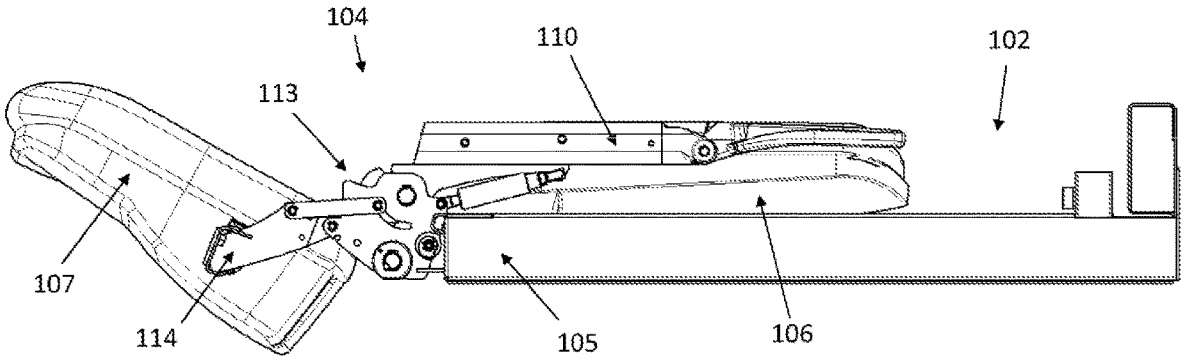
FIG. 10 shows a side view of a double action nose mounted chair according to the present invention in the stored position.
Figure 11:
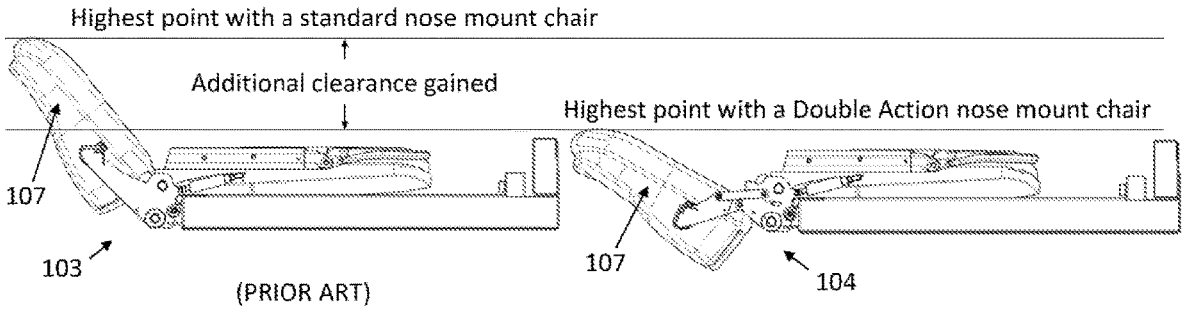
FIG. 11 shows a side by side comparison showing the clearance gained by using the double action nose mounted chair.

To bring the chairs back to the used position, the back assemblies 106 must be rotated forward and upward as is standard with a nose mounted chair. As the pin 118 travels back through the arcuate slot 121 in the rear bracket 115, it pulls on the pivot straps 116 thus pulling the front bracket 114 and seat bottom assembly 107 upward and back into the used position. FIG. 9 is an isometric view of a double action nose mounted chair 104 and FIG. 10 shows a side view of a double action nose mounted chair 104 in the stored position. Together FIG. 9 and FIG. 10 provide views of the double action chair 104 in its stored and used positions respectively.

Figure 12:
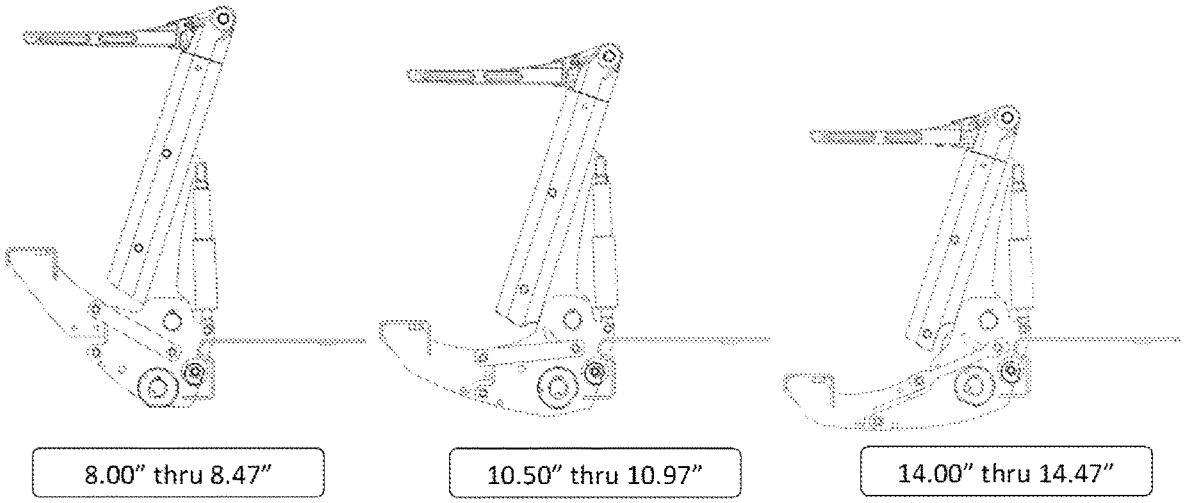
FIG. 12 shows multiple rise ranges of the double action nose mount stanchion.

The exact geometry of the pivot straps 116, rear bracket 115 and front bracket 114 may depend on the given rise that the chair is being installed on. Splitting the chair or seat mounting brackets 112 into two components (a front 114 and rear bracket 115) keeps the same overall dimensions and can be applied to any rise stanchion to make the chair unit into a double action stanchion 113 by providing the arcuate slots 121, straps 116 and pivot pins according to the present invention described herein. FIG. 12 shows multiple rise ranges of the double action nose mount stanchion 113.

The foregoing description has been directed to particular embodiments. However, other variations and modifications may be made to the described embodiments, with the attainment of some or all of their advantages. Modifications to the above-described systems and methods may be made without departing from the concepts disclosed herein. Accordingly, the invention should not be viewed as limited by the disclosed embodiments. Furthermore, various features of the described embodiments may be used without the corresponding use of other features. Thus, this description should be read as merely illustrative of various principles, and not in limitation of the invention.

What is claimed is:

1. A stanchion assembly for use in a double action seating unit having a seat back assembly and a seat bottom assembly, the stanchion assembly comprising:

a rear bracket;

a stanchion tube, pivotably mounted to the rear bracket at a first pivot point, and configured to attach to the seat back assembly;

a front bracket, pivotably mounted to the rear bracket at a second pivot point, and configured to attach to the seat bottom assembly; and first and second pivot straps, coupled to the stanchion tube and to the front bracket, whereby upon rotating the stanchion tube in a first direction about the first pivot point, the first and second pivot straps cause the front bracket to rotate around the second pivot point in a second direction that is opposite to the first direction.

2. The stanchion assembly of claim 1, wherein the first and second pivot straps are pivotally attached to the stanchion tube by a first pin passing through the first and second pivot straps and the stanchion tube, and wherein the first and second pivot straps are further pivotably attached to the front bracket by a second pin passing through the pivot strap and the front bracket.

3. The stanchion assembly of claim 2, wherein the rear bracket further includes first and second side plates, and wherein the stanchion tube further includes a stanchion tube center plate disposed between the first and second side plates of the rear bracket, and wherein the first pin passes through the first and second pivot straps and a hole in the stanchion tube center plate.

4. The stanchion assembly tube of claim 3 wherein the first and second side plates include first and second curved slots, respectively, and wherein the first pin also passes through said first and second curved slots.

5. The stanchion tube of claim 4 wherein the first and second curved slots are arcuate slots that arc around the first pivot point.

6. The stanchion tube of claim 2 wherein said first pin passes through said first and second pivot straps and the stanchion tube, and wherein the second pin passes through said first and second pivot straps and the front bracket.

7. A double action seating unit to be mounted to a nose of a platform, wherein the double action seating unit is configured to move between a use configuration and a storage configuration, the double action seating unit comprising:

a seat bottom assembly;

a seat back assembly; and at least two stanchions, each of said at least two stanchions including a front bracket, a rear bracket, a stanchion tube and two pivot straps, wherein each front bracket is pivotably attached to a respective rear bracket at a front bracket pivot point and is configured to attach to the seat bottom assembly, wherein the rear bracket of each of said at least two stanchions is configured to attach the respective stanchion to the nose of the platform, wherein each stanchion tube is pivotably attached to a respective rear bracket at a stanchion tube pivot point and is configured to attach to the seat back assembly, wherein each of the two pivot straps is configured to connect an associated stanchion tube coupled to an associated rear bracket with an associated front bracket coupled to the associated rear bracket, and wherein the two pivot straps of each of said at least two stanchions are further configured to simultaneously move the seat bottom assembly and the seat back assembly when the double action seating unit moves between the use configuration and the storage configuration, wherein the stanchion tube is configured to rotate about the stanchion tube pivot point in a first direction such that the seat back assembly is pivoted backwards and downwards towards a storage configuration while simultaneously the two pivot straps push the front bracket causing the front bracket to rotate about the front bracket pivot point in a second direction, opposite from said first direction, whereby rotating the stanchion tube in said first direction about the stanchion tube pivot point is configured to pivot the seat bottom assembly forwards and downwards towards a storage configuration, and wherein the stanchion tube is configured to rotate about the stanchion tube pivot point in a second direction such that the seat back assembly is pivoted forwards and upwards towards a use configuration while simultaneously the two pivot straps pull the front bracket causing the front bracket to rotate about the front bracket pivot point in the first direction, opposite from said second direction, whereby rotating the stanchion tube in said second direction about the stanchion tube pivot point is configured to pivot the seat bottom assembly backwards and upwards towards said use configuration.

8. A seating system comprising a plurality of the double action seating units of claim.

9. The seating system of claim 8, wherein the seating system includes a top row of seats and at least one lower row of seats.

10. The seating system of claim 9, wherein the top row of seats comprise the plurality of double action seating units.

11. The seating system of claim 10, wherein the at least one lower row of seats comprises a plurality of single action seating units.

12. The double action seating unit of claim 7, further comprising at least one armrest.

13. The double action seating unit of claim 12, wherein the stanchion tube of at least one of the at least two stanchions is further configured to attach the seat back assembly and the at least one armrest to the at least one of the at least two stanchions.

14. The double action seating unit of claim 7, wherein the rear bracket includes first and second side plates including curved slots.

15. The double action seating unit of claim 14, further comprising a pivot point for the stanchion tube, and wherein the curved slots of the first and second side plates are around the pivot point for the stanchion tube.

16. The double action seating unit of claim 15, further comprising a pin that goes through a hole in the two pivot straps, the curved slots and a hole in the stanchion tube.

* * * * *